US006412150B1

(12) United States Patent
Monderine

(10) Patent No.: US 6,412,150 B1
(45) Date of Patent: Jul. 2, 2002

(54) FASTENING DEVICE

(76) Inventor: Cathy Ann Monderine, 764 N. 155th St., Omaha, NE (US) 68154

( * ) Notice: Subject to any disclaimer, the term of this patent is extended or adjusted under 35 U.S.C. 154(b) by 0 days.

(21) Appl. No.: 09/551,315

(22) Filed: Apr. 18, 2000

Related U.S. Application Data

(60) Provisional application No. 60/129,869, filed on Apr. 19, 1999.

(51) Int. Cl.[7] ..... A44B 11/25; F16L 3/100

(52) U.S. Cl. ..... 24/563; 24/543; 24/200

(58) Field of Search ..... 24/168–170, 178, 24/182, 200, 563, 543, 545, 327, 3.1, 3.12, 487, 176; 248/316.5; 2/126, 94, 243

(56) References Cited

U.S. PATENT DOCUMENTS

| | | | | |
|---|---|---|---|---|
| 1,285,657 A | | 11/1918 | Finucan | |
| 1,342,048 A | | 6/1920 | Hultman et al. | |
| 3,013,797 A | | 12/1961 | Schwartz | |
| D193,497 S | | 9/1962 | Kelley | |
| D193,498 S | | 9/1962 | Kelley | |
| 3,965,545 A | * | 6/1976 | Johansson | 24/176 X |
| 4,400,855 A | * | 8/1983 | Stuart | 24/200 |
| 4,484,379 A | * | 11/1984 | Appelt et al. | 24/200 X |
| 4,897,900 A | * | 2/1990 | Baggett | 24/543 |
| 4,923,153 A | * | 5/1990 | Matsui et al. | 24/178 X |
| D351,493 S | | 10/1994 | DeCinque | |
| 5,653,003 A | * | 8/1997 | Freeman | 24/543 |
| 5,937,745 A | * | 8/1999 | Boe | 24/543 X |

* cited by examiner

*Primary Examiner*—Robert J. Sandy
(74) *Attorney, Agent, or Firm*—Rothwell, Figg, Ernst & Manbeck

(57) ABSTRACT

A fastening device for securing and mounting elements used in costuming and decoration, includes an upper plate having at least one interior bar for looping the elements onto the upper plate, and having openings on both sides of the interior bar, and a lower plate with a securing mechanism for securing the lower plate to the upper plate, so that when the plates are secured together the looped elements are held into place on the fastening device which is attached to a costume, clothing or other article.

10 Claims, 3 Drawing Sheets

FASTENING DEVICE

This application is related to U.S. Provisional Application, Ser. No. 60/129,869, filed Apr. 19, 1999, which is incorporated herein by reference.

FIELD OF INVENTION

This invention relates to a fastening device, and more particularly, to a fastening device for securing and mounting designs on costumes or clothing.

BACKGROUND AND SUMMARY OF THE INVENTION

For theatrical purposes or play, having a costume or other decorative addition to a costume or clothing increases the overall visual appeal. Presently, fabricating wing-like designs for costuming and decoration is an elaborate and time consuming process. After the designs are made, attaching the designs to the costumes or clothing usually requires sewing machines and hand detailing. The results are often less than desirable. Many of these fairy wings are contrived and clumsy. Not only do they require labor intensive sewing, but they are costly to produce. For example, U.S. Pat. No. 3,013,797 discloses elaborate wings which are sewn into a robe type costume. Some wing-like structure are completely attached to the arms and sides of shirt, such as in U.S. Pat. No. D 351,493. Although these wings described in the previously-mentioned patents are securely affixed to the costumes, their use is limited in that they require a considerable amount of time and expense to assemble.

There is a need for a fastening device for attaching wings and other items to costumes and clothing that is economical and aesthetically pleasing. In addition, there is a need for a fastening device that quickly and easily attaches wing-like designs to costumes and clothing. Moreover, there is a need for a fastening device that can be used to assemble a variety of elements together. There is also a need to provide a fastening device that is durable and reusable. Still another need is for a fastening device that may be used by individuals of various ages and skill levels.

The fastening device of the present invention secures and mounts elements used in costuming and decoration quickly and easily to costumes and clothing. Not only does the present fastening device create an aesthetically pleasing result, but it may be used by individuals of many different skill levels and ages. In addition, the fastening device may be used to assemble a variety of elements together and then it may be reused. The fastening device of the present invention is durable and securely attaches elements into place and is easily removed after use. In general, the fastening device of the present invention includes an upper plate and a lower plate. The upper plate has an opening for receiving the elements. The lower plate includes a securing mechanism for securing the lower plate to the upper plate and holding the elements in place on the fastening device. A bent bridging bar hinges the upper plate to the lower plate on a side opposite the securing mechanism. Fabrication elements are looped over and under the upper plate through the opening. The elements are then sandwiched between the lower plate and the upper plate and then secured together by applying manual pressure to the securing mechanism.

These and other features and advantages will be in part apparent, and in part pointed out hereinafter.

DESCRIPTION OF DRAWINGS

Corresponding reference numerals indicate corresponding parts throughout the several views of the drawings.

DETAILED DESCRIPTION OF THE PREFERRED EMBODIMENT

A first embodiment of the fastening device constructed according to the principles of this invention is indicated generally as 10 in FIGS. 1–5. Fastening device 10 secures and mounts elements such as angel wings and the like, used in costuming and decoration. Fastening device 10 may also be used for making large bows and securing them to costuming or clothing. In addition, fastening device 10 may be used to secure detachable dress trains to a dress, for wedding veils, dress embellishments and for various other uses.

Figure 1:
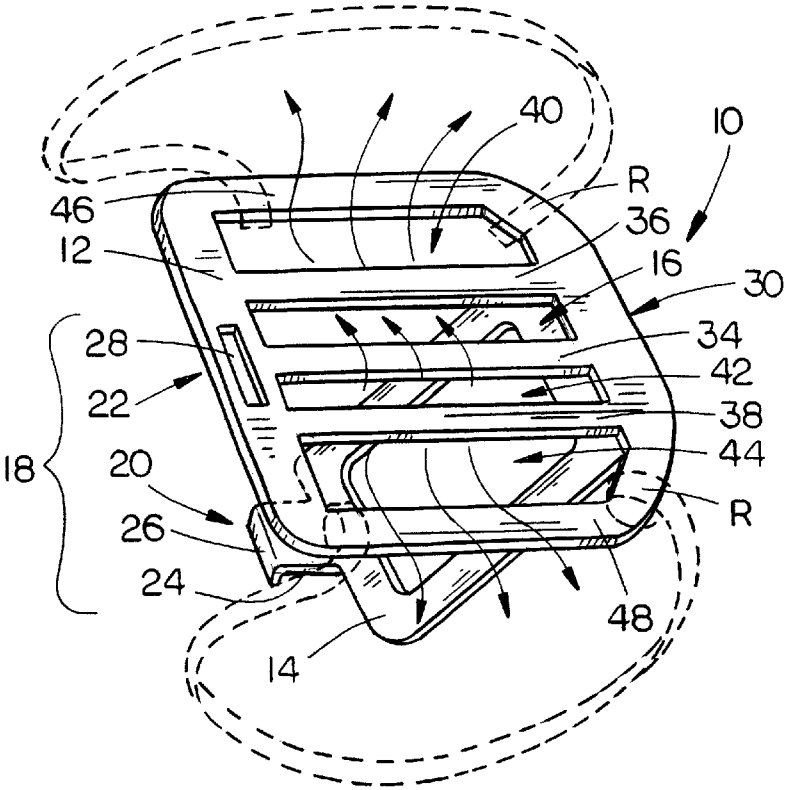
FIG. 1 is a perspective view of the fastening device according to the principles of this invention with the directional flow of the fabrication material shown in phantom lines.

As shown in FIG. 1, fastening device 10 is preferably rectangular in shape, and slightly tapers inwardly at one of its outer edges. However, fastening device 10 may be made in various sizes and shapes to accommodate the particular application desired. Fastening device 10 is completely reusable so it may be used repetitively with a variety of different elements without causing damage to the elements or the device. In particular, fastening device 10 includes an upper plate 12 and a lower plate 14. Upper and lower plates, 12 and 14, are preferably made of a planar material that is uniformly thick. The material is rigid enough to support a variety of different elements of various weights so that both simplistic and extravagant elements may be secured into place. In addition, the material is flexible enough to withstand repeated bending without fracturing in subsequent applications. For example, material such as plastic and the like may be used. Fastening device 10 may be injection molded or formed in other suitable ways to achieve the desired shape. In the preferred embodiment, upper plate 12 is made of a lighter gauge material than lower plate 14 to allow a degree more of flexibility. Upper plate 12 includes at least one opening 16 for receiving the costume or decorative elements, as described more fully hereinafter. Fastening device 10 includes a securing mechanism 18 for securing lower plate 14 and upper plate 12 together and thereby holding the elements tightly in place on fastening device 10.

In the preferred embodiment, securing mechanism 18 comprises a mating element 20 on lower plate 14 which is adapted to engage a respective mating element 22 on upper plate 12. Preferably, mating element 20 is a flange 24 and respective mating element 22 is a slot 28. Flange 24 extends outwardly from lower plate 14, and then extends inwardly at its upper end forming a ridge 26. Slot 28 of respective mating element 22 is formed of a predetermined size to receive ridge 26 of flange 24. Mating element 20 and respective mating element 22 may also be snaps, Velcro®, and the like, or other securing mechanisms which will securely hold upper and lower plates 12 and 14 together. Securing mechanism 18 is preferably positioned on fastening device 10 opposite a bent bridging bar 30.

Figure 2:
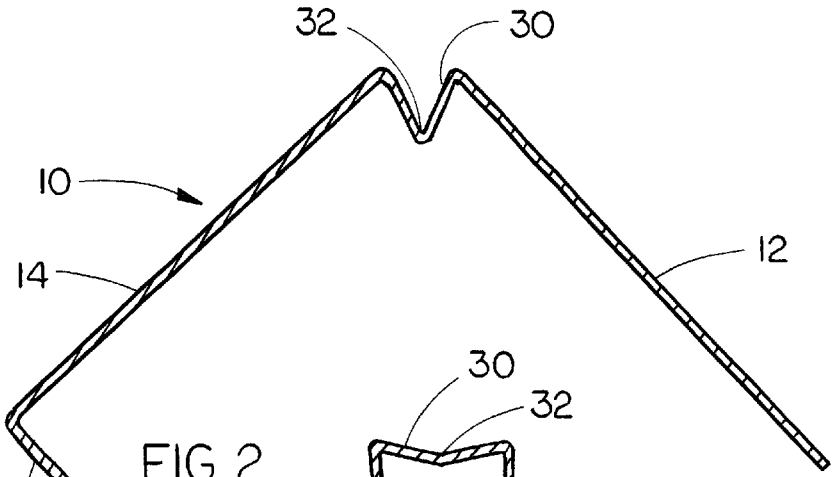
FIG. 2 is a side plan view of the fastening device according to the principles of this invention in an open position.

FIG. 2 is a side plan view of fastening device 10 showing bent bridging bar 30. In the preferred embodiment, upper and lower plates 12 and 14 are hinged together with bent bridging bar 30. Preferably, bent bridging bar 30 has a fold 32 at its center. The rigid material of fastening device 10 provides for repeated folding at fold 32 without causing breakage. Bent bridging bar 30 allows upper and power plates 12 and 14 to pivot between the open position of fastening device 10, shown in FIG. 2, and the fully closed and engaged position, shown in FIG. 3. Upper plate 12 and lower plate 14 are interlocked when they are rotated into the closed position and manual pressure is applied to mating element 20 so that it is pressed into respective mating element 22. Flange 24 engages slot 28 by ridge 26 which extends over an edge of slot 28 preventing disengagement until upper and lower plates 12 and 14 are manually separated. The elements are thus sandwiched to fastening device 10 when mating element 20 is pressed into respective mating element 22. Securing mechanism 18 provides for reuse of both fastening device 10 and the elements since they are not damaged by use of the mechanism.

Figure 5:
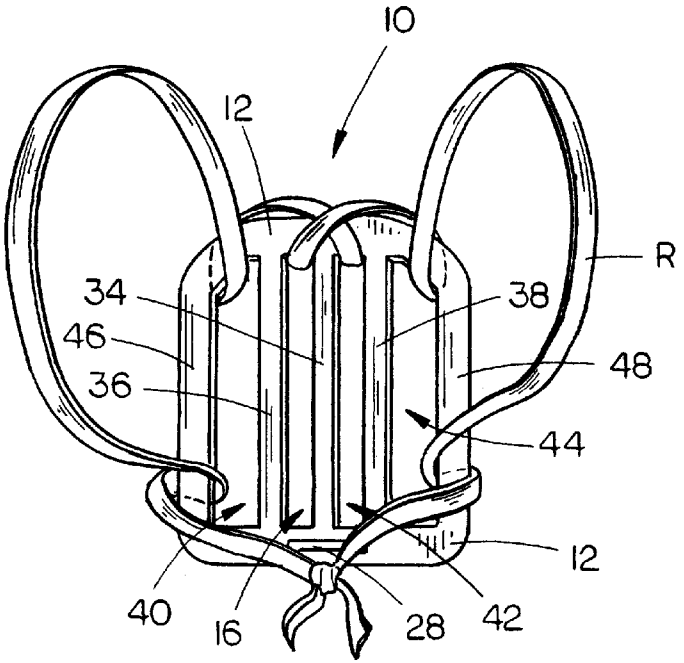
FIG. 5 is a top plan view of the fastening device according to the principles of this invention shown with a temporary mounting on the upper plate.
Figure 4:
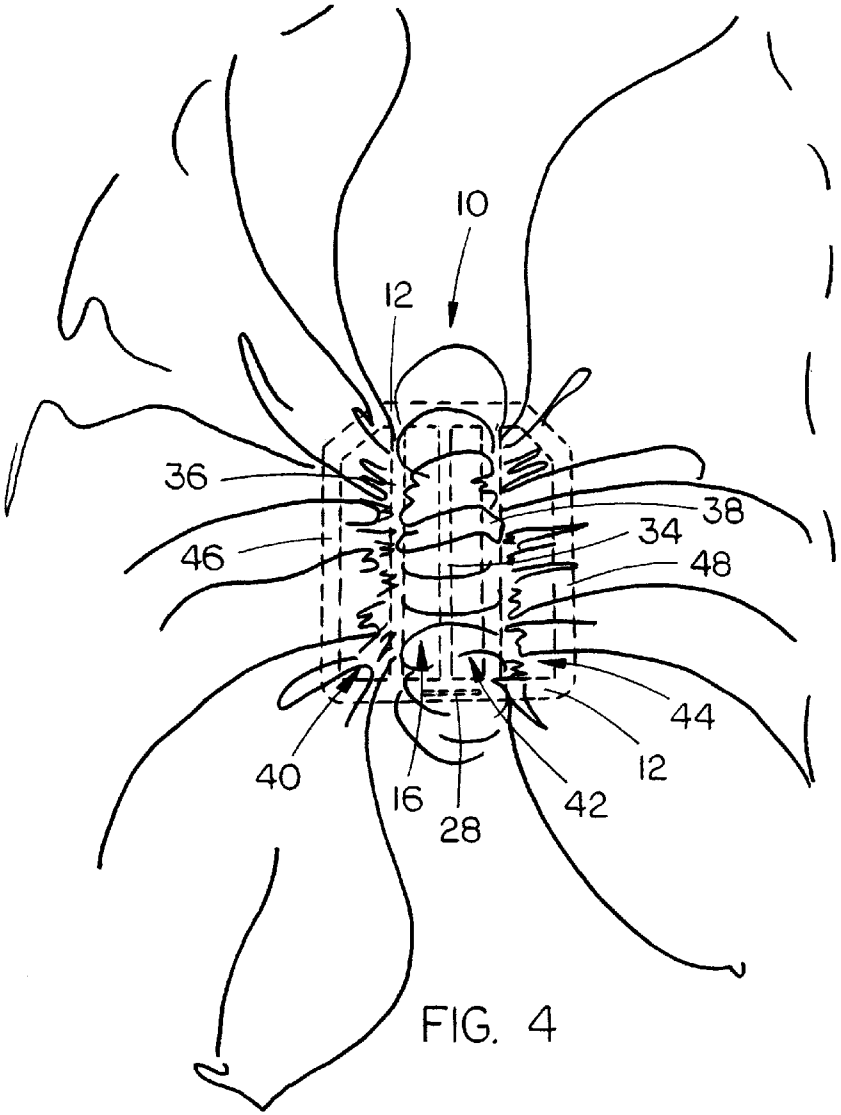
FIG. 4 is a top plan view of the fastening device according to the principles of this invention shown with a fabrication threaded through the upper plate and fanned out.

FIG. 4 is a top plan view of fastening device 10 according to the principles of this invention shown with a fabrication threaded through upper plate 12 and then fanned out. Upper plate 12 preferably includes at least one interior bar 34 for looping the fabrication and other elements onto upper plate 12. In the preferred embodiment, upper plate includes additional interior bars 36 and 38. Each interior bar 34, 36 and 38 has openings 16, 40, 42 and 44, respectively on each side for receiving the elements. As shown in FIG. 5, upper plate 12 also includes exterior bars 46 and 48 for securing fastening device 10 to the costume or clothing. Ribbon, elastic or other suitable material R is looped or permanently affixed to exterior bars 46 and 48 for securing the fabrication to fastening device 10.

Figure 6:
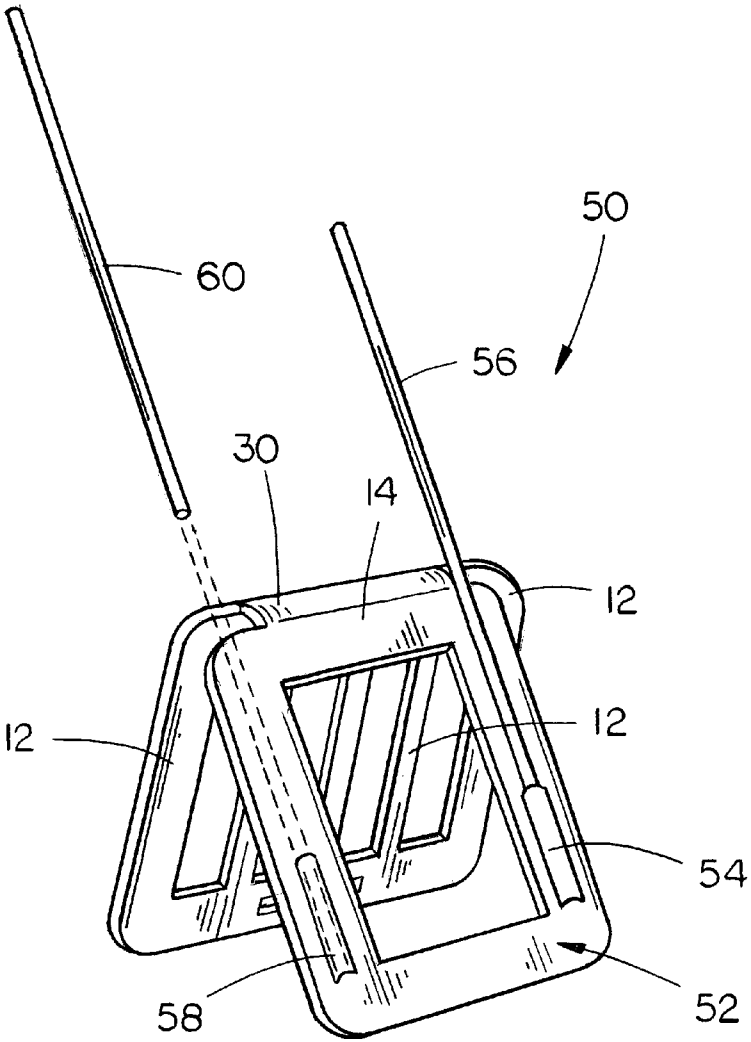
FIG. 6 is rear perspective view of a second embodiment of the fastening device according to the principles of this invention shown with stabilizing support bars being attached to the elongated eyes.

FIG. 6 is rear perspective view of a second embodiment of a fastening device 50 according to the principles of this invention. Lower plate 14 has a rear side 52 that is opposite upper plate 12. At least one elongated eye 54 is attached to rear side 52. Elongated eye 54 is adapted for receiving a stabilizing support bar 56. Lower plate 14 preferably includes a second elongated eye 58 positioned parallel to elongated eye 54. Elongated eye 54 and second elongated eye 58 are on opposite sides of lower plate 14 and both protrude outwardly from its surface. Preferably, elongated eye 54 and second elongated eye 58 are molded onto lower plate 14 or glued onto its outer surface. Elongated eyes 54 and 58 are arch-shaped, thereby forming tunnels adapted for receiving stabilizing support bar 56 and a second stabilizing support bar 60. Stabilizing support bars 56 and 60 are preferably dowels or other bars sturdy enough to hold additional fabrication into place on fastening device 50. Stabilizing support bars 56 and 60 are attached to elongated eyes 54 and 58 respectively, by sliding the bars into the tunnel-shaped eyes. Stabilizing support bars 56 and 60 are threaded through elongated eyes 54 and 58 until an even amount of bar extends from either end of the element. Fabrications and other material may then be secured to the top and/or sides of bars 56 and 60 by a variety of methods including hot glue, pinning and sewing. Stabilizing support bars 56 and 60 may also be made of various desired lengths to accommodate the particular elements.

Figure 7:
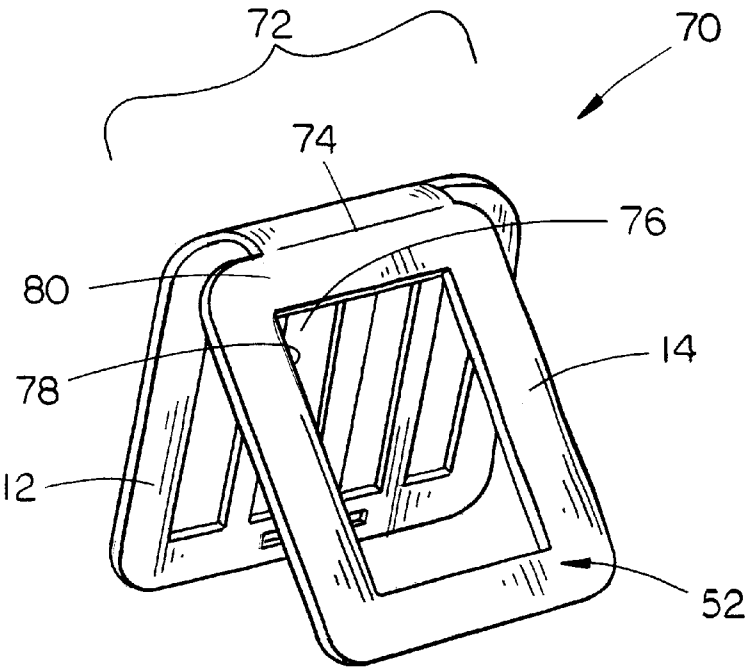
FIG. 7 is a rear perspective view of a third embodiment of the fastening device according to the principles of this invention shown with a pin attachment.

FIG. 7 is a rear perspective view of a third embodiment of a fastening device 70 according to the principles of this invention shown with a pin attachment 72. Pin attachment 72 secures to rear side 52 of lower plate 14. Pin attachment 72 is useful for temporarily securing smaller, lighter weight attachments to fastening device 70. Specifically, pin attachment 72 includes a pin 74 having an end 76 that is pivotally mounted to lower plate 14. Pin 74 has a second end 78 that is opposite mounted end 76. Second end 78 of pin 74 is pushed in and out of the article grasping a portion of the article, and then hooked into a pin cradle 80. Pin cradle 80 extends outwardly from lower plate 14, and preferably is a small hook sized and positioned to receive second end 78 to secure fastening device and the attachments together.

OPERATION

In operation, fastening device 10 may be either permanently or temporarily affixed to the costume, clothing or other article. For permanently affixing fastening device 10 to the article, bands are secured to upper plate 12 by looping them through openings 40, 42, 16 and 44 and around exterior bars 46 and 48, as shown in FIG. 5, thereby securely attaching the bands into place. The bands of ribbon, elastic or other suitable material R may also be glued, sewn or otherwise secured directly to exterior bars 46 and 48 without looping. Alternatively, material R may be temporarily attached to upper plate 12 by looping a single length of material R around exterior bars 46 and 48 and interior bars 34, 36 and 38 of upper plate 12. Furthermore, in the third embodiment of the invention, smaller, lighter weight articles may be temporarily secured to fastening device 70. These articles are temporarily secured to fastening device 70 by using pin attachment 72. Second end 78 of pin 74 is pushed in and out of the article grasping a portion of the article, and then hooked into pin cradle 80 thereby securing fastening device 70 to the article.

In the second embodiment of fastening device 50, stabilizing support bars 56 and 60 are inserted into elongated eyes 54 and 58 respectively. Stabilizing support bars 56 and 60 hold additional fabrication into place on fastening device 50. Stabilizing support bars 56 and 60 are threaded through elongated eyes 54 and 58 until an even amount of bar extends from either end of the element. Material is secured to the top and/or sides of bars 56 and 60 with hot glue, pins, sewing, or by another desired method.

Figure 3:
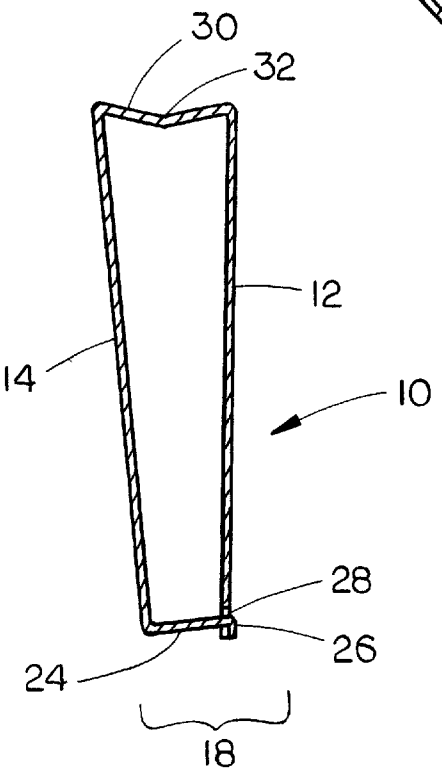
FIG. 3 is a side plan view of the fastening device according to the principles of this invention in a fully closed and engaged position.

After the fastening device is secured to the article either temporarily or permanently, elements are applied to upper plate 12 by looping the elements over interior bar 34 and under interior bars 36 and 38 as shown by the directional arrows in FIG. 1. Elements are then pulled up through openings 16, 40, 42 and 44 and then manually fanned out to achieve desired design as in shown in FIG. 4. Lower plate 14 is then pivoted toward upper plate 12 about fold 32 of bent bridging bar 30. Bent bridging bar 30 allows upper and power plates 12 and 14 to pivot between the open position of fastening device 10, shown in FIG. 2, and the fully closed and engaged position as shown in FIG. 3. Manual pressure is applied to press mating element 20 into respective mating element 22 thereby interlocking upper plate 12 and lower plate 14 together. Specifically, flange 24 is inserted through slot 28 and then held into place by ridge 26. Ridge 26 extends over an edge of slot 28 holding upper and lower plates 12 and 14 in the fully closed and engaged position until they are manually separated for subsequent use. The elements are thus sandwiched between upper and lower plates 12 and 14 when flange 24 is pressed into slot 28 ultimately engaging slot 28 with ridge 26.

Accordingly, the fastening device can be used to creatively, economically and expediently create costume designs including, but not limited to the fabrication of wings.

Although embodiments of the invention have been shown and described, these should not be construed as limiting the scope of the invention. It is to be understood that various modifications and substitutions can be made by those skilled in the art without departing from the spirit and scope of this invention.

I claim:

1. A fastening device for securing and mounting elements used in costuming and decoration, comprising:

an upper plate having a first interior bar, a second interior bar, and a third interior bar for looping the elements onto said upper plate, and having openings on both sides of said first, second and third interior bars; and a lower plate having a securing mechanism for securing said lower plate to said upper plate; whereby said lower plate attaches to said upper plate and holds the elements in place on said fastening device.

2. The fastening device of claim 1 further comprising a bent bridging bar connecting said upper plate to said lower plate.

3. The fastening device of claim 2 wherein said securing mechanism is opposite said bent bridging bar and comprises a mating element on said lower plate adapted to engage a respective mating element on said upper plate; whereby said upper plate and said lower plate are interlocked when manual pressure is applied to said mating element and said respective mating element thereby sandwiching the elements to the fastening device.

4. The fastening device of claim 3 wherein said mating element is a flange extending outwardly from said lower plate and said respective mating element is a slot adapted to receive said flange.

5. The fastening device of claim 4 wherein said flange further comprises a ridge which protrudes over an edge of said slot.

6. The fastening device of claim 1 wherein said lower plate has a rear side opposite said upper plate, and further comprises at least one elongated eye on its rear side, adapted for receiving a stabilizing support bar.

7. The fastening device of claim 6 wherein said lower plate further comprises a second elongated eye, and said at least one elongated eye and said second elongated eye protrude outwardly parallel to each other along opposite sides of said lower plate, and are adapted for receiving said stabilizing support bar and a second stabilizing support bar.

8. The fastening device of claim 1 wherein said lower plate has a rear side and further comprises a pin attachment on its rear side, for temporarily mounting said fastening device to the elements.

9. The fastening device of claim 8 wherein said pin attachment further comprises a pin having an end pivotally mounted to said lower plate and a second end opposite said mounted end, and a pin cradle extending outwardly from said lower plate positioned to secure said second end.

10. The fastening device of claim 9 wherein said pin cradle is a small hook.

* * * * *